United States Patent [19]

Koyama

[11] 3,972,959

[45] Aug. 3, 1976

[54] PROCESS FOR PREPARING PHENOLIC FILAMENTS

[75] Inventor: Hiroaki Koyama, Osaka, Japan

[73] Assignee: Nippon Kynol Inc., Osaka, Japan

[22] Filed: Oct. 22, 1974

[21] Appl. No.: 517,029

[30] Foreign Application Priority Data

Oct. 24, 1973 Japan ..... 48-119673

[52] U.S. Cl. ..... 260/841; 8/115.5; 260/54; 260/55; 260/56; 260/59 R; 260/843; 260/847; 260/848; 264/176 F; 264/236; 264/347

[51] Int. Cl.[2] ..... D06M 13/12; D06M 13/16; D06M 13/20

[58] Field of Search ..... 260/59 R, 841; 264/177 F, 176 F, 236, 347; 8/115.5

[56] References Cited

UNITED STATES PATENTS

| | | | |
|---|---|---|---|
| 3,716,521 | 2/1973 | Economy et al. | 260/59 |
| 3,808,289 | 4/1974 | Okuhashi et al. | 260/841 |
| 3,848,044 | 11/1974 | Hagiwara et al. | 260/59 |

*Primary Examiner*—John C. Bleutge
*Attorney, Agent, or Firm*—Sherman & Shalloway

[57] ABSTRACT

A process for producing melt-spun and cured phenolic filaments having improved tenacity and whiteness which comprises treating cured phenolic filaments with an alcohol having 1 to 6 carbon atoms or acetone and reacting the thus-treated phenolic filaments with an esterifying solution containing acetic anhydride in the presence of an inorganic acid of phosphorus as an esterifying catalyst.

13 Claims, No Drawings

PROCESS FOR PREPARING PHENOLIC FILAMENTS

This invention relates to a process for preparing phenolic fibers having superior tenacity and whiteness.

Phenolic filaments obtained by melt-spinning a fiber-forming uncured phenolic resin derived from a phenol and an aldehyde and curing the resulting filaments are generally infusible and non-inflammable because of their high carbon content and cross-linked structure, and also have superior chemical resistance. These favorable properties have made them applicable to a broad range of usages such as apparel, wall cloth, curtains, and various filters.

Uncured phenolic filaments have previously been cured by a variety of methods such as a method using an acid catalyst and an aldehyde, a method using a basic catalyst and an aldehyde, and a method comprising pre-curing the filaments with an aldehyde using an acid catalyst, and then curing them with an aldehyde in the presence of a basic catalyst.

The cured phenolic filaments obtained by such methods, however, are colored red or red-brown, and have especially low color fastness to heat or light so that they discolor to dark brown within short periods of time under the action of heat or light. Accordingly, they are quite unsatisfactory for use in interior decoration such as wall cloth or curtains, as well as for apparel use.

In an attempt to remedy this defect, there have previously been suggested a method which comprises esterifying the hydroxyl or methylol group of phenolic filaments, after curing, with acetic anhydride in the presence of a strong acid such as sulfuric acid or p-toluenesulfonic acid, a metal halide such as zinc chloride or iron chloride, or a weakly basic catalyst such as a monoamine, a diamine or pyridine thereby to form white phenolic fibers, or a method which comprises esterifying cured phenolic filaments with a mixture of acetic anhydride and acetic acid containing 20 to 80% by weight of the acetic anhydride in the presence of a catalyst comprising zinc, aluminum, iron or an amalgam of such a metal.

When a strong acid is used as catalyst in the above-mentioned method, white phenolic filaments can be obtained. But in this case, the esterification bath used tends to be colored, and the contamination of the esterification bath may lead to a marked deterioration of the whiteness of the esterified filaments. The esterification bath cannot therefore be re-used as such. Furthermore, the sulfone groups from sulfuric acid or p-toluenesulfonic acid adhere physically and chemically to the filaments to reduce the color fastness of the filaments to light to a great extent.

On the other hand, when a metal halide or a weakly basic catalyst is used, the contamination of the esterification bath can be reduced, but even by a long-time esterification reaction, it is difficult to obtain phenolic filaments having a high level of whiteness. Especially when a metal halide is used as a catalyst, the esterification bath tank is heavily corroded, and it is difficult to prepare white phenolic filaments on a mass-production basis.

With any of the above methods, phenolic filaments having a high degree of curing, that is high tenacity, are difficult to esterify. In addition, since the denier size of the phenolic filaments increases upon esterification, the tenacity of the esterified filaments is reduced in inverse proportion to the increase of the denier size.

We have now found that phenolic filaments having high whiteness, superior colorfastness to light, and high tenacity and elongation can be obtained easily on a commercial scale without impairing the desirable properties of the phenolic filaments such as non-inflammability, infusibility, and superior chemical resistance.

It is an object of this invention to provide a process for producing phenolic filaments having high whiteness and superior colorfastness to light.

Another object of this invention is to provide a process for producing white phenolic filaments having superior tenacity and elongation on a commercial scale.

The above objects of this invention can be achieved by a process for producing melt-spun and cured phenolic filaments consisting essentially of a novolak resin in an amount of more than 50% by weight based on the total weight of the filaments and a fiber-forming thermoplastic synthetic resin in an amount of less than 50% by weight based on the total weight of the filaments, and having improved tenacity and whiteness, which comprises contacting cured phenolic filaments with a treating agent in the vapor or liquid phase, said treating agent containing at least 25% by weight of at least one member selected from the group consisting of alcohols containing from 1 to 6 carbon atoms, acetone and mixtures thereof, the filaments being contacted with the treating agent before or during the drawing of the filaments, and reacting the thus-treated phenolic filaments with an esterifying solution containing at least 30% by weight of acetic anhydride as an esterifying agent and 0.3 to 20% by weight of an inorganic acid of phosphorus as an esterifying catalyst at a temperature of about 90° to 140°C. to esterify the phenolic hydroxyl or methylol groups of said novolak resin in the filaments.

The term "phenolic filaments", as referred to in this application, generically denotes fibrous shaped articles of phenolic resins, especially novolak resins, which are polycondensates formed between phenols and aldehydes, and fibrous shaped articles of mixtures of the above-mentioned polycondensates between phenols and aldehydes with fiber-forming thermoplastic synthetic resins. In the above mixtures, the amount of the phenolic resin is more than 50% by weight based on the total weight of the filaments, and the amount of the fiber-forming synthetic resin is less than 50% by weight based on the total weight of the filaments.

The term "phenols", as referred to herein, generically denotes compounds resulting from the replacement of the hydrogen atoms bonded to a benzene ring by hydroxyl groups. Examples of the phenols are phenol, o-cresol, m-cresol, p-cresol, 2,3-xylenol, 2,4-xylenol, 2,5-xylenol, 2,6-xylenol, 3,4-xylenol, 3,5-xylenol, o-ethylphenol, m-ethylphenol, p-ethylphenol, p-phenylphenol, p-t-butyl phenol, bisphenol A, and resorcinol. The phenol, m-cresol, p-cresol, and resorcinol are especially preferred. Mixtures of these phenols can also be used.

The term "aldehyde", as referred to herein, generically denote compounds containing aldehyde groups. Examples of the aldehydes are formaldehyde, para-formaldehyde, benzaldehyde, and furfural.

The phenols and the aldehydes can be easily polycondensed by heating in the presence of an acid catalyst. The polycondensates obtained can be fiberized by melt-spinning techniques. Similarly, by mixing chips of the polycondensates formed between the phenols and the aldehydes with the fiber-forming thermoplastic synthetic resins and then melting the mixture, or by mixing them in the molten state, mixed polymers can be easily obtained. The molten mixed polymers can be fiberized by extrusion spinning.

The term "fiber-forming thermoplastic synthetic polymers or resins", as referred to in the present application, generically denote polyamides such as 6-nylon, 7-nylon, 9-nylon, 11-nylon, 12-nylon, 6,6-nylon, 6,10-nylon, 6T nylons expressed by the general formula

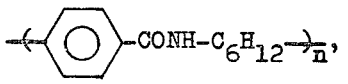

and 11T-nylons expressed by the general formula

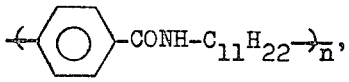

copolymers composed mainly of these, polyesters such as polymethylene terephthalate, polyethylene terephthalate, polybutylene terephthalate, polyethylene hydroxy terephthalate, and polycyclohexylene terephthalate, copolymers consisting mainly of these, polyolefins such as polyethylene, polypropylene, polystyrene, polyvinylidene chloride and polyvinyl chloride, copolymers consisting mainly of these, and polyurethane polymers. These thermoplastic polymers can also be used as mixtures.

The melt-spun phenolic filaments are then submitted to a curing treatment in order to render them infusible. Usually, this curing treatment is carried out by immersing the phenolic filaments in an aldehyde solution containing an acid or basic catalyst, or spraying this solution onto the phenolic filaments. Sometimes, both of an aldehyde containing an acid catalyst and an aldehyde containing a basic catalyst are used successively, or sometimes, an aldehyde containing both an acid catalyst and a basic catalyst is used.

It has been found very desirable to use phenolic filaments prepared by pre-curing as-spun phenolic filaments with an acid catalyst and an aldehyde, and then curing them with a basic catalyst and an aldehyde in order to achieve the objects of this invention. This two-step curing treatment permits the preparation of filaments having a low degree of coloration, and the filaments can be uniformly cured within short periods of time even to their insides. Accordingly, when esterification is carried out subsequently, the esterification catalyst and acetic anhydride can easily penetrate even to the inside of the filaments, and accordingly, phenolic filaments having a high level of whiteness can be obtained with commercial ease.

A preferred embodiment of the two-step curing treatment will be described as follows: In the first-stage curing, melt-spun uncured phenolic filaments are immersed in a mixed aqueous solution of an acid and an aldehyde at 15° to 30°C. for 5 to 20 hours, or treated for 0.5 to 5 hours after heating the above solution to 40° to 105°C. while the filaments are being immersed therein. Or this treatment is carried out in a vapor of an acid and an aldehyde at a temperature of 30° to 105°C. These different types of treatment may be employed conjointly. Rates of temperature raising of more than 200°C./hour should be avoided as it results in the melting and melt-adhering of the filaments. Generally, the mixed aqueous solution contains 6.0 to 40% by weight, preferably 15 to 25% by weight, of the acid and 6.0 to 40% by weight, preferably 15 to 25% by weight, of the aldehyde.

The second-stage curing is carried out by immersing the phenolic filaments, which have been partially cured by the above first-stage treatment, in an aqueous solution of an aldehyde in the presence of a basic catalyst, or in a vapor of these. When using the aqueous solution, the filaments are immersed in the aqueous solution kept at 15° to 40°C., and in this state, the temperature of the aqueous solution is gradually raised to 40° to 105°C. to treat the filaments for 20 to 120 minutes. Preferably, the rate of temperature raising is not more than 50°C./hour. Alternatively, the filaments are immersed in the aqueous solution kept at 40° to 105°C., and treated for 15 to 90 minutes. When the curing treatment is performed at an elevated pressure, the curing temperature can be higher than 105°C. When using a vapor of the aldehyde and the basic catalyst, the curing treatment is carried out at a temperature of 30° to 105°C. for 20 to 120 minutes. Usually, ammonia is used as the basic catalyst. Most preferably, the curing treatment using a basic catalyst is carried out in an aqueous solution of formaldehyde and ammonia at 60° to 80°C. for 30 to 60 minutes. The concentrations of the aldehyde and the basic catalyst differ according to such factors as the treating temperature and the treating time. Usually, the concentration of the aldehyde is 1 to 60% by weight, preferably 12 to 45% by weight, especially preferably 20 to 35% by weight, and the concentration of the basic catalyst is 0.2 to 20% by weight, preferably 1 to 10% by weight, especially preferably 2.0 to 3.5% by weight.

In summary, the two-step curing treatment described above comprises immersing uncured phenolic filaments in an aldehyde such as formaldehyde in the presence of an acid catalyst at a temperature of not more than 105°C. or exposing the filaments to a vapor of the aldehyde and the catalyst, thereby to cure the surface of the filaments, preferably washing the cured filaments with water, and then immersing them in an aqueous solution of an aldehyde such as formaldehyde in the presence of a basic catalyst or exposing them to a vapor of the catalyst and the aldehyde at a temperature of not more than 120°C., thereby to rapidly cure the uncured portion inside the filaments.

When phenolic filaments are cured by a one-step curing treatment using an acid catalyst and an aldehyde, the curing of only the surface of the filaments tends to proceed, and therefore, it is desirable to control the operating conditions to avoid this tendency.

The cured phenolic filaments used as a starting material in the present invention may be those cured by any curing method. However, from the viewpoint of the whiteness of the esterified filaments finally obtained, they are preferably those obtained by a two-step curing treatment comprising precuring the filaments with an acid catalyst and an aldehyde, and then curing them with a basic catalyst and an aldehyde.

The acid catalyst used for curing the melt-spun and uncured phenolic filaments may, for example, be various organic and inorganic acids, for example, hydrochloric acid, sulfuric acid, nitric acid, acetic acid, oxalic acid, formic acid, orthophosphoric acid, metaphosphoric acid, lactic acid, benzenesulfonic acid, p-toluenesulfonic acid and boric acid, or mixtures of these. Examples of the basic catalyst are ammonia, sodium hydroxide, potassium hydroxide, calcium hydroxide, sodium carbonate, hexamethylene tetramine, various other amines, and mixtures of the above compounds.

Prior to the esterification step, the cured phenolic filaments are treated with a solution or vapor of a lower alcohol containing 1 to 6 carbon atoms and/or acetone in a concentration of at least 25% by weight, preferably at least 35% by weight, and more preferably at least 50% by weight.

Examples of the lower alcohols containing 1 to 6 carbon atoms include methyl alcohol, ethyl alcohol, propyl alcohol, isopropyl alcohol, butyl alcohol, isobutyl alcohol, sec.-butyl alcohol, tert.-butyl alcohol, amyl alcohol, and hexyl alcohol. This treatment with the lower alcohol produces an effect of extracting any monomeric phenol or aldehyde remaining in the filaments, removing colored impurities, and swelling the filaments. Especially favorable results can be obtained with methyl alcohol, ethyl alcohol and propyl alcohol, the methyl alcohol giving an especially outstanding effect.

The concentration of the lower alcohol or acetone in liquid or solution form should be at least 25% by weight. The solvent for preparing the solution is usually water, but other solvents can be optionally used as desired.

Where the lower alcohol and acetone are vaporous, the content of the lower alcohol and/or acetone in the vapor should be at least 25% by weight. If the concentration is less than 25% by weight, the elongation of the treated filaments is quite non-uniform, and it is difficult to obtain filaments having high elongation. This makes it necessary to consume long periods of time for the subsequent esterification reaction of the filaments, and filaments of a high degree of whiteness are difficult to obtain. The pH of the bath or vapor in this case is not critical. Even when the treatment is carried out in alkalinity with a pH of 10, there can be obtained esterified filaments having superior tenacity and high whiteness. Furthermore, in the above treatment, the phenolic filaments should not necessarily be in the relaxed state, but may be in the taut state.

The filaments can be treated with the treating agent before or during the drawing of these filaments.

The treating temperature and time are chosen arbitrarily having regard to the concentrations of the lower alcohol and acetone, etc. When the treating temperature is low, the treating time becomes longer. Usually, the treatment of the cured filaments with the treating agent is carried out at 30° to 70°C. for 5 to 60 minutes.

In this treatment, the phenolic filaments are swollen and relaxed by the action of the lower alcohol and/or acetone, and monomeric phenol and aldehyde or low polymers of aldehydes remaining in the filaments are extracted and are removed by the action of the lower alcohol and/or acetone present on the surface of the filaments. The color of the filaments thus becomes light as a result of decoloration, and their tenacity and elongation increase.

Since this treatment results in the removal of the monomers or low polymers of aldehydes in the filaments, the esterification of the filaments in the subsequent step becomes easy, thus permitting acetic anhydride and the inorganic acid of phosphorus to diffuse into the inside of the filaments extremely easily. As a result, not only is the esterification completed within short periods of time, but also esterified filaments of superior tenacity and elongation with little non-uniformity of the elongation can be obtained.

The phenolic filaments pre-treated with the lower alcohol and/or acetone by the process of this invention are usually washed with acetic acid, and then esterified with an at least 30% by weight aqueous solution of acetic anhydride in the presence of an inorganic acid of phosphorus. Examples of the conventional esterification catalysts, and the various difficulties with these conventional esterification catalysts have already been described above.

It is noted in particular that when the conventional catalysts are used, the white esterified filaments tend to have reduced strength and on the other hand, the denier size of the filaments increases by 20 to 30%. Accordingly, it was considered as natural that their tenacity decreases by 30 to 40%.

According to the process of this invention, cured phenolic filaments are swollen with the lower alcohol and/or acetone to render them readily esterifiable, and then esterified using an at least 30% by weight solution of acetic anhydride in the presence of an inorganic acid of phosphorus as an esterifying catalyst. Surprisingly, the inorganic acid of phosphorus gives esterified filaments having higher whiteness and better colorfastness to light than other esterifying catalysts do. The strength of the esterified filaments is higher than that of phenolic filaments before esterification to a greater degree than in the case of using other catalysts. Thus, it has been found that in spite of an increase in denier size, the tenacity of the filaments does not decrease. The inorganic acids of phosphorus are very useful in commercial production since they scarcely exhibit a corrosive action against general materials of equipment, such as stainless steel.

The inorganic acid of phosphorus used as an esterifying catalyst generically refers to hypophosphorus acid, metaphosphoric acid, phosphorus acid, orthophosphoric acid, phosphoric anhydride, pyrophosphoric acid, and mixtures of these.

The concentration of the inorganic acid of phosphorus in the esterification bath used in the process of this invention is about 0.3 to 20% by weight, preferably about 0.6 to 10% by weight, and more preferably about 1.0 to 5.0% by weight. If the concentration is less than 0.3% by weight, it is impossible to obtain phenolic filaments having high whiteness even if the filaments are sufficiently pre-treated with the lower alcohol and/or acetone. On the other hand, if the concentration exceeds 20% by weight, the reduction of the quality of the filaments and the contamination of the esterification bath result.

The concentration of the acetic anhydride in the esterification bath is at least 30% by weight, preferably 40 to 80% by weight, especially preferably 50 to 70% by weight. When the concentration of the acetic anhydride is less than 30% by weight, long periods of time are required for esterification, and filaments having high whiteness cannot be obtained. Usually, the esterification bath contains acetic acid in addition to acetic anhydride and inorganic acids of phosphorus. Since the esterification bath has the best ability to swell and esterify the filaments when the concentration of the acetic anhydride is 50 to 70% by weight, the use of a bath having an excessively high concentration of acetic anhydride should desirably be avoided.

The esterification in the process of this invention is carried out usually at 90° to 140°C. for 1 to 60 minutes, preferably at 100° to 130°C. for 5 to 30 minutes.

If the above esterification temperature is lower than 90°C., it is difficult to esterify phenolic filaments of high tenacity. When the temperature exceeds 140°C., the esterification needs to be performed in the gaseous phase. Accordingly, the esterification involves difficulty in view of the availability of suitable equipment, and cannot be performed uniformly. Furthermore, the tenacity and elongation of the filaments are reduced.

Since in the present invention, the phenolic filaments pre-treated with the lower alcohol and/or acetone have a very low degree of coloration and are readily esterifiable, the esterification reaction of the filaments is completed within a short period of time. But in order to esterify even the inside of the filaments uniformly, it is desirable to perform it for more than 5 minutes. If the esterification reaction is carried out for excessively long periods of time, it sometimes results in the reduction of the tenacity and elongation of the filaments.

When the white esterified filaments obtained by the process of this invention are further treated with the lower alcohol containing 1 to 6 carbon atoms and/or acetone (which are pre-treating agents) either as such or as a mixture with a solvent therefor and a basic chemical, the odor and stain of the filaments can be effectively removed.

Thus, according to the process of this invention, phenolic filaments having high whiteness and tenacity and elongation can be obtained within short periods of time without involving the coloration of the esterifying solution by first pre-treating cured phenolic filaments with a lower alcohol containing 1 to 6 carbon atoms and/or acetone, and then esterifying them with an at least 30% by weight solution of acetic anhydride in the presence of an inorganic acid of phosphorus as an esterifying catalyst. Since the filaments so obtained have excellent colorfastness to light, they are not discolored after dyeing, and can find a broad range of utility as apparel, wall cloth, curtains, and various filters.

The following Examples illustrate the present invention in greater detail. In these Examples, the whiteness and yellowness were measured by the following methods.

WHITENESS

Measured in accordance with JIS-L 1073, 5, 17A which sets forth a method for testing synthetic filament yarns. The measurement is conducted using a spectrophotometer having a reflective light measuring instrument attached thereto. A white index (%) is calculated from a spectral reflective index characteristic curve measured with respect to a visible light range (400 to 700 nm) as against a reference white board.

YELLOWNESS

The value calculated from the Taylor's equation. YI (yellowness index) = $[(1.28\ X - 1.06Z/Y] \times 100$

EXAMPLE 1

A novolak resin having a number average molecular weight of 870 and a logarithmic viscosity $[\eta]$ of 0.071 obtained by polycondensing phenol and formaldehyde in the presence of an oxalic acid catalyst was melt-spun at 140°C. using a spinneret having 36 holes each having a diameter of 2.5 mm, and wound up at a rate of 650 meters/min. The resulting filaments had an average denier size of 2.7 d, an average tenacity of 0.2 g/d and an average elongation of 1.0%.

The filaments were immersed in a mixed aqueous solution containing 16% by weight of hydrochloric acid and 15% by weight of formaldehyde at 30°C. The solution was heated to 90°C. over the course of 60 minutes, and the filaments were maintained at 90°C. for 3 hours. The filaments were then washed with water, immersed in a mixed aqueous solution containing 2.5% by weight by weight of ammonia and 18% by weight of formaldehyde, and maintained at 95°C. for 60 minutes to cure the filaments.

The resulting cured phenolic filaments were red-brown, and had an average denier size of 3.05 denier, an average tenacity of 1.65 g/d and an elongation of 16% with an increase in weight of 15% by weight.

The filaments were treated with each of the treating agents indicated in Table 1 below at 60°C. for 30 minutes, washed with acetic acid, and then immersed in a mixed solution consisting of 1% by weight of orthophosphoric acid, 65% by weight of acetic anhydride and 34% by weight of acetic acid. The solution was heated from room temperature to 115°C. in the course of 15 minutes, and then, the filaments were treated therein at 115°C. for 10 minutes. The filaments so treated were then washed with acetic acid and with water, and then dried at 90°C. for 60 minutes. Table 1 shows the various treating agents, the weight decrease (symbol - shows the decrease) of the filaments after the pretreatment, and the whiteness of the esterified filaments.

Table 1

| Pre-treating agent | Rate of weight decrease of the filaments after pretreatment (wt. %) | Whiteness (%) of the esterified filaments |
|---|---|---|
| No pre-treatment | 0 | 11 |
| 15 wt. % aqueous solution of methanol | −0.6 | 19 |
| 25 wt. % aqueous solution of methanol | −1.9 | 41 |
| 50 wt. % aqueous solution of methanol | −2.9 | 55 |
| 70 wt. % aqueous solution of methanol | −3.1 | 61 |
| 100 wt. % methanol | −2.7 | 57 |
| 100 wt. % methanol | −2.0 | 43 |
| 100 wt. % propanol | −1.6 | 40 |
| 100 wt. % n-amyl alcohol | −1.5 | 36 |
| 70 wt. % aqueous solution of acetone | −2.0 | 39 |
| 70 wt. % aqueous solution of dimethyl formamide | −0.2 | 14 |
| 100 wt. % tetrahydrofuran | 0 | 11 |
| 100 wt. % benzene | 0 | 8 |
| 50 wt. % aqueous solution of ethyl acetate | −0.6 | 15 |
| 100 wt. % acetic acid | 0 | 2 |
| 2 wt. % aqueous solution of ammonia | −0.5 | 1 |

The results shown in Table 1 demonstrate that when the filaments are pre-treated with methanol, ethanol, propanol, n-amyl alcohol or acetone in a concentration of at least 25% by weight, the weight decrease rate of the filaments is high. This is considered to be due to the dissolving of the low polymers, etc. in the filaments into the pre-treating solvent. In fact, it was confirmed by infrared absorption spectrum that the residue resulting from the removal of the solvent from the treating solution after the treatment consists of phenols and aldehydes. On the other hand, the whiteness of the filaments increases with increasing rate of the weight decrease.

On the other hand, the weight decrease of the filaments treated with other treating solvents is low, and the esterified filaments are not white.

EXAMPLE 2

The same cured phenolic filaments as in Example 1 were immersed in a mixed aqueous solution containing 2% by weight of ammonia and 50% by weight of methanol and having a pH of 10 for 30 minutes at 60°C. The filaments so pre-treated were washed with water, and dried at 80°C. for 60 minutes. The color of the resulting filaments was yellowish green.

The filaments were then poured in a mixture consisting of 1% by weight of each of the various esterifying catalysts shown in Table 2, 60% by weight of acetic anhydride and 39% by weight of acetic acid at 110°C., and allowed to react at this temperature for 30 minutes. After the reaction, the filaments were withdrawn, washed with acetic acid, and then with water, and treated in a 70% by weight aqueous solution of methanol at 50°C. for 30 minutes thereby to remove the stain of the filaments which resulted from the use of the esterifying catalyst such as sulfuric acid. The filaments were again washed with water, and dried to form esterified filaments.

Table 2 shows the various catalysts used, the contamination of the esterifying bath after use, and also the weight increase, denier size, strength, tenacity, elongation, whiteness and yellowness of the resulting esterified filaments. The yellowness was measured after exposing the filaments for 20 hours to a fade-Ometer using a Xenon lamp.

Table 2

| Type of esterifying catalyst | Contamination of the esterifying bath | Weight increase (wt.%) | Denier size (d) | Strength (g) | Tenacity (g/d) | Elongation (%) | Whiteness (%) | Yellowness after exposure (%) |
|---|---|---|---|---|---|---|---|---|
| (Filaments before esterification) | — | — | 3.0 | 5.0 | 1.67 | 58 | 5 | 110 |
| o-phosphoric acid | Transparent | 37 | 3.9 | 6.7 | 1.71 | 43 | 59 | 28 |
| Hypophosphorous acid | " | 33 | 3.8 | 6.3 | 1.65 | 40 | 53 | 33 |
| Phosphorous acid | " | 31 | 3.7 | 6.2 | 1.67 | 41 | 50 | 29 |
| Pyrophosphoric acid | " | 28 | 3.5 | 5.9 | 1.69 | 41 | 46 | 38 |
| Zinc acetate | " | 8 | 3.1 | 4.6 | 1.47 | 31 | 1 | 65 |
| Potassium acetate | " | 5 | 3.2 | 4.6 | 1.45 | 32 | 4 | 70 |
| Sulfuric acid | Contaminated | 29 | 3.5 | 3.9 | 1.12 | 21 | 44 | 99 |
| p-Toluenesulfonic acid | " | 31 | 3.8 | 4.9 | 1.28 | 38 | 51 | 68 |
| Zinc chloride | " | 32 | 3.6 | 4.5 | 1.25 | 40 | 48 | 32 |
| Iron chloride | " | 21 | 3.4 | 4.0 | 1.19 | 30 | 8 | 69 |
| Phosphorus oxychloride | Transparent | 16 | 3.5 | 4.7 | 1.33 | 36 | 22 | 86 |
| Pyridine | " | 4 | 3.2 | 4.8 | 1.51 | 43 | 21 | 96 |
| Monoethylamine | " | 12 | 3.3 | 4.3 | 1.29 | 39 | 5 | 62 |
| Hydrochloric acid | " | 3 | 3.2 | 4.6 | 1.43 | 45 | 14 | 70 |
| Zinc phosphate | " | 8 | 3.5 | 5.0 | 1.45 | 40 | 2 | 66 |

It is seen from the results shown in Table 2 that when ortho-phosphoric acid, phosphorous acid, hypophosphorous acid, and pyrophosphoric acid are used as an esterifying catalyst, the esterifying bath is not contaminated, and white filaments having superior quality, whiteness and colorfastness to light can be obtained. In particular, the strength of the esterified filaments showed an increase over that of the filaments before esterification.

On the other hand, when other catalysts were used, problems were presented with regard to the contamination of the esterifying bath, the reduction of tenacity, and the whiteness of the esterified filaments, and the marked coloration of the esterified filaments after exposure to light.

EXAMPLE 3

A test piece of stainless steel (SUS-32) was put into an esterifying bath containing an o-phosphoric acid catalyst, and an esterifying bath containing a zinc chloride catalyst (the same type as used in Example 2), respectively, and maintained at 123°C. for 8 hours. Table 3 shows the coloration of each of the esterifying bath, and the weights of the test piece before and after the above corrosion test.

Table 3

| Type of catalyst | Contamination of the esterifying bath | Weight of the test piece before testing (g) | Weight of the test piece after testing (g) |
|---|---|---|---|
| o-Phosphoric acid | Light yellow, transparent | 22.1210 | 22.1211 |
| Zinc chloride | Black brown, non-transparent | 20.0233 | 19.9815 |

It can be seen from the results shown in Table 3 that when the orthophosphoric catalyst is used, neither the corrosion of the stainless steel test piece nor the contamination of the esterifying bath is observed, but that in the case of using zinc chloride, the coloration and contamination of the esterifying bath are heavy, and the weight of the test piece decreases.

EXAMPLE 4

A novolak resin having a logarithmic viscosity [$\eta$] of 0.069 and a number average molecular weight of 830 obtained by polycondensing a mixed phenol consisting of phenol and m-cresol in a ratio of 8:2 and formaldehyde in the presence of a hydrochloric acid catalyst was melt-spun under the same conditions as in Example 1 to form uncured phenolic filaments having a denier size of 2.7 d, a tenacity of 0.3 g/d and an elongation of 0.8%.

The filaments were immersed in a mixed aqueous solution containing 13% by weight of hydrochloric acid, 5% by weight of sulfuric acid and 16% by weight of formaldehyde at 35°C., and the temperature of the aqueous solution was raised to 90°C. over the course of 90 minutes. The filaments were then washed with water, and subsequently, immersed in a bath containing 3.0% by weight of ammonia and 30% by weight of formaldehyde which was prepared by using hexamethylene tetramine and paraformaldehyde, and cured at 95°C. for 60 minutes. The cured phenolic filaments thus obtained had a denier size of 2.9 d, a tenacity of 1.54 g/d, and an elongation of 16%.

The cured filaments were treated at 70°C. for 60 minutes in a 80% by weight aqueous solution of ethanol, washed well with acetic acid, and then esterified at 80° to 124°C. for 0 to 120 minutes in a mixture of 1.5% by weight of pyrophosphoric acid, 55% by weight of acetic anhydride and 43.5% by weight of acetic acid. Table 3 shows the reaction time (the time after the predetermined temperature was attained) and the whiteness of the esterified filaments. In either case, heating to the predetermined temperature was performed over the course of 20 minutes.

Table 4

| Temperature (°C) Time (minutes) | 80 | 90 | 100 | 115 | 124 |
|---|---|---|---|---|---|
| 0 | 10 | 22 | 28 | 40 | 47 |
| 1 | 13 | 23 | 37 | 43 | 53 |
| 5 | 19 | 32 | 41 | 51 | 49 |
| 10 | 21 | 37 | 39 | 48 | 55 |
| 30 | 20 | 42 | 40 | 50 | 49 |
| 60 | 22 | 39 | 41 | 48 | 51 |
| 120 | 23 | 36 | 39 | 49 | 52 |

As is seen from Table 4, esterified filaments of high whiteness are difficult to obtain at a temperature of 80°C., but at a temperature of 90°C. or higher, phenolic filaments having superior whiteness can be obtained within short periods of time. At 124°C., the esterifying bath boiled, and at normal atmospheric pressure, the esterification reaction at a higher temperature could not be performed.

EXAMPLE 5

The same cured phenolic filaments as obtained in Example 1 were treated at 65°C. for 60 minutes in a 50% by weight aqueous solution of methanol, washed with water, and then dried. The resulting filaments were treated at 120°C. for 20 minutes in a mixture consisting of 65% by weight of acetic anhydride and 35% by weight of acetic acid in the presence of 0.1 to 30% by weight of o-phosphoric acid.

The amount of the orthophosphoric acid used, and the whiteness, tenacity and elongation of the esterified filaments are shown in Table 5.

Table 5

| Amount of o-phosphoric acid (wt. %) | 0.1 | 0.3 | 0.6 | 1.0 | 5.0 | 10 | 20 | 30 |
|---|---|---|---|---|---|---|---|---|
| Whiteness (%) | 3 | 38 | 43 | 50 | 53 | 50 | 48 | 37 |
| Tenacity (g/d) | 1.42 | 1.45 | 1.57 | 1.68 | 1.64 | 1.59 | 1.33 | 1.08 |
| Elongation (%) | 37 | 34 | 36 | 39 | 40 | 38 | 26 | 13 |

Table 5 demonstrates that 0.3 to 20% concentrations of orthophosphoric acid give good results.

EXAMPLE 6

The same novolak resin as obtained in Example 1 and a molten mixture of 90% by weight of the above novolak resin and 10% by weight of 12-nylon were melt-spun at a conjugate ratio of 1:1 through a spinneret having 18 holes each having a diameter of 3.0 mm, and wound up at a rate of 1000 meters/min. The filaments were cured under the same conditions as in Example 4, and then treated in a 80% by weight aqueous solution of methanol. The resulting filaments had a denier size of 3.1 d, a tenacity of 1.56 g/d and an elongation of 65%, and contained 10 crimps per 2.5 cm. The filaments were washed with acetic acid, and then immersed in an acetic acid solution containing 20 to 97% by weight of acetic anhydride to perform the esterification reaction of these filaments at 110°C. for 20 minutes.

Table 6 below shows the concentration of the acetic anhydride, and the whiteness, tenacity and elongation of the esterified filaments.

Table 6

| Concentration of acetic anhydride (wt. %) | 20 | 30 | 40 | 50 | 60 | 70 | 80 | 97 |
|---|---|---|---|---|---|---|---|---|
| Whiteness (%) | 12 | 41 | 50 | 60 | 58 | 54 | 56 | 45 |
| Tenacity (g/d) | 1.46 | 1.31 | 1.44 | 1.54 | 1.58 | 1.52 | 1.45 | 1.34 |
| Elongation (%) | 53 | 50 | 48 | 51 | 47 | 47 | 42 | 35 |

EXAMPLE 7

The uncured phenolic filaments obtained in Example 1 were immersed in a mixed aqueous solution containing 18% by weight of hydrochloric acid and 16% by weight of formaldehyde at 25°C., and the temperature of the aqueous solution was raised to 98°C. over the course of 2 hours. The filaments were maintained at this temperature for 1 hour and 6 hours, respectively, to cure the filaments, and then dried at 50°C. under reduced pressure for 2 hours. The resulting two kinds of filament samples were divided in equal parts. One part was kept untreated, and the other part was treated for 60 minutes with a 60% by weight aqueous solution of methanol. These samples were immersed respectively in a mixture consisting of 2% by weight of orthophosphoric acid, 60% by weight of acetic anhydride and 38% by weight of acetic acid, and esterified at 115°C. for 20 minutes.

Table 7 shows the time during which the phenolic filaments were maintained at 98°C. in the curing step, the degree of curing (weight increase %), and the whiteness, tenacity and elongation of the esterified filaments.

Table 7

| Time for maintaining the filaments (hours) | Degree of curing (wt.%) | Pre-treatment | Whiteness (%) | Tenacity (g/d) | Elongation (%) |
|---|---|---|---|---|---|
| 1 | 7.3 | No | 41 | 0.71 | 9 |
| 1 | 7.3 | Yes | 52 | 0.85 | 18 |
| 6 | 15.1 | No | 19 | 1.45 | 20 |
| 6 | 15.1 | Yes | 46 | 1.63 | 43 |

As can be seen from Table 7, when phenolic filaments having a low degree of curing are esterified, the esterified filaments have high whiteness irrespective of whether they have been pre-treated, but have low tenacity and elongation. On the other hand, when the degree of curing is high, esterified filaments with superior whiteness, tenacity and elongation can be obtained only when the filaments have been pre-treated in accordance with the process of this invention.

EXAMPLE 8

The cured phenolic filaments obtained in Example 1 were treated in a 50% by weight aqueous solution of methanol at 60°C. for 30 minutes, washed with water, and dried at 80°C. for 60 minutes. The resulting filaments assumed a light brown color.

A woven fabric prepared from a two-ply 30-count yarn made of the above filaments was immersed in a mixture consisting of 3% by weight of phosphoric acid, 65% by weight of acetic anhydride and 32% by weight of acetic acid, and esterified at 118°C. for 60 minutes to form a white woven fabric.

When the white woven fabric so obtained was placed in flame, it was not melted and burned, but carbonized.

EXAMPLE 9

90% by weight of the same novolak resin as used in Example 1 and 10% by weight of 12-nylon were melted and mixed, and defoamed under reduced pressure. The molten mixture was melt-spun and then cured under the same conditions as in Example 1. The cured phenolic filaments were treated at 60°C. for 60 minutes in a 70% by weight aqueous solution of methanol. The phenolic filaments were then treated at 110°C. for 30 minutes in a mixture consisting of 5% by weight of metaphosphoric acid, 55% by weight of acetic anhydride and 40% by weight of acetic acid.

The resulting esterified filaments had a denier size of 3.8 d, a tenacity of 1.52 g/d, an elongation of 41%, and a whiteness of 51%, and were infusible and non-inflammable.

What we claim is:

1. A process for producing melt-spun and cured phenolic filaments consisting essentially of a novolak resin in an amount of more than 50% by weight based on the total weight of the filaments and a fiber-forming thermoplastic synthetic resin in an amount of less than 50% by weight based on the total weight of the filaments and having improved tenacity and whiteness, which comprises contacting cured phenolic filaments with a treating agent in the vapor or liquid phase, said treating agent containing at least 25% by weight of at least one member selected from the group consisting of alcohols containing from 1 to 6 carbon atoms, acetone and mixtures thereof, the filaments being contacted with the treating agent before or during the drawing of the filaments, and reacting the thus-treated phenolic filaments with an esterifying solution containing at least 30% by weight of acetic anhydride as an esterifying agent and 0.3 to 20% by weight of an inorganic acid of phosphorus as an esterifying catalyst at a temperature of about 90° to 140°C. to esterify the phenolic hydroxyl or methylol groups of said novolak resin in the filaments.

2. The process of claim 1 wherein said treating agent is an aqueous solution of methanol in a concentration of at least 25% by weight.

3. The process of claim 1 where said treating agent is an aqueous solution of methanol in a concentration of at least 35% by weight.

4. The process of claim 1 wherein said treating agent is an aqueous solution of methanol in a concentration of at least 50% by weight.

5. The process of claim 1 wherein the contacting of the cured phenolic filaments with the treating agent is performed at a temperature of about 30° to 70°C. for about 5 to 60 minutes.

6. The process of claim 1 wherein the concentration of the acetic anhydride in the esterifying solution is about 40 to 80% by weight.

7. The process of claim 1 wherein the concentration of the acetic anhydride in the esterifying solution is about 50 to 70% by weight.

8. The process of claim 1 wherein said inorganic acid of phosphorus in the esterifying solution is ortho-phosphoric acid.

9. The process of claim 1 wherein the concentration of the inorganic acid of phosphorus in the esterifying solution is about 0.6 to 10% by weight.

10. The process of claim 1 wherein the concentration of the inorganic acid of phosphorus in the esterifying solution is about 1 to 5% by weight.

11. The process of claim 1 wherein the esterification reaction is carried out at a temperature of 90° to 140°C. for a period of 1 to 60 minutes.

12. The process of claim 1 wherein the esterification reaction is carried out at a temperature of 100° to 130°C. for a period of 5 to 30 minutes.

13. The process of claim 1 wherein the cured phenolic filaments used as a starting material are cured filaments obtained by pre-treating uncured phenolic filaments using an acid catalyst and formaldehyde, and then curing the filaments using a basic catalyst and formaldehyde.

* * * * *